US006062756A

United States Patent [19]

Sasaki

[11] Patent Number: 6,062,756

[45] Date of Patent: May 16, 2000

[54] PUSH-BUTTON WRITING INSTRUMENT

[75] Inventor: Kazuhiko Sasaki, Isesaki, Japan

[73] Assignee: Kabushiki Kaisha Pilot, Tokyo-to, Japan

[21] Appl. No.: 09/297,280

[22] PCT Filed: Aug. 14, 1998

[86] PCT No.: PCT/JP98/03629

§ 371 Date: Apr. 28, 1999

§ 102(e) Date: Apr. 28, 1999

[87] PCT Pub. No.: WO99/11472

PCT Pub. Date: Mar. 11, 1999

[30] Foreign Application Priority Data

Aug. 28, 1997 [JP] Japan ..... 9-247633

[51] Int. Cl.[7] ..... B43K 24/08

[52] U.S. Cl. ..... 401/111

[58] Field of Search ..... 401/109, 110, 401/111, 131

[56] References Cited

U.S. PATENT DOCUMENTS

| | | | |
|---|---|---|---|
| 3,205,863 | 9/1965 | Rhoades | 401/111 |
| 3,273,541 | 9/1966 | Thurman et al. | 401/111 |
| 3,464,774 | 9/1969 | Vetter | 401/110 |
| 4,205,924 | 6/1980 | Sumita | 401/65 |
| 5,152,626 | 10/1992 | Eppler | 401/104 |

FOREIGN PATENT DOCUMENTS

| | | |
|---|---|---|
| 6-328891 | 7/1994 | Japan . |
| 6-49078 | 7/1994 | Japan . |
| 7-33680 | 6/1995 | Japan . |

*Primary Examiner*—Henry J. Recla
*Assistant Examiner*—Peter deVore
*Attorney, Agent, or Firm*—Wenderoth, Lind & Ponack, L.L.P.

[57] ABSTRACT

A push-button writing instrument has a refill (5) slidably inserted in a barrel (2) and is biased toward the back end of the barrel by a spring (6). The writing instrument is provided with a refill operating mechanism (10) capable of projecting a writing tip part (4) of the refill (5) from the open front end (2*a*) of the barrel (2) and retracting the same into the barrel (2) when operated by exerting a pressure in the range of 500 to 800 grams to a push-button (7). The writing tip part (4) is retracted into the barrel by a distance of about 3 mm from the open front end (2*a*). The push-button writing instrument is able to employ a conventional refill operating mechanism. The writing tip part (4) of the writing instrument does not project from the open front end (2*a*) of the barrel (2) when a force on a touching level is applied to the push-button while the writing instrument is kept in a pocket or the like.

5 Claims, 2 Drawing Sheets

PUSH-BUTTON WRITING INSTRUMENT

TECHNICAL FIELD

The present invention relates to a push-button writing instrument provided with a refill operating mechanism having a spring biasing a refill slidably inserted in a barrel toward the back of the barrel, and a push-button which is operated to project a writing tip attached to the front end of the refill from the open front end of the barrel and to retract the same behind the open front end of the barrel.

BACKGROUND ART

A generally known push-button writing instrument is provided with a refill operating mechanism having a spring biasing a refill slidably inserted in a barrel toward the back of the barrel, and a push-button which is operated to project a writing tip attached to the front end of the refill from an open front end of the barrel and to retract the same behind the open front end of the barrel.

When the push-button writing instrument is held in place in a pocket, it sometimes occurs that the push-button is pushed unintentionally by hand and so on and the writing tip is projected accidentally from the front end part of the barrel. If the writing instrument uses an ink, such as a water-based ink of a low viscosity or an oil-based ink of a viscosity not higher than 3,000 mPa·s at 25° C., the ink will exude from the writing instrument and the pocket will be stained with the ink.

Recently, there have been provided various writing instruments including push-button writing instruments and using a thixotropic ink generally called a gel ink having a high viscosity when left standing and have a low viscosity when stirred by a rolling ball or the like for writing. The thixotropic ink is contained in a refill without using any ink absorbing wadding or the like which is used for holding a water-based ink. Therefore, if the writing tip part of the push-button writing instrument provided with a refill containing a thixotropic ink is projected accidentally from the front end part of the barrel, and a ball held on the writing tip part is rolled by being rubbed with the fabric of a pocket or the like, the viscosity of the thixotropic ink decreases, and a large amount of the thixotropic ink infiltrates the fabric or is absorbed by the fabric by the capillary action of the fabric.

Accordingly, a push-button writing instrument provided with a refill containing a low-viscosity ink or a thixotropic ink is provided with a safety mechanism capable of preventing the writing tip part of the refill from projecting out of the open front end of the barrel even if the push-button is operated accidentally at least when the push-button writing instrument is inserted and held in a pocket or the like.

However, the push-button writing instrument provided with such a safety mechanism in addition to the refill operating mechanism has a complicated mechanism, and needs additional parts. Therefore, it is difficult to employ such a safety mechanism in a low-price push-button writing instrument in view of problems in manufacture.

In view of such problems, the inventors of the present invention made studies to provide a push-button writing instrument provided with a refill operating mechanism analogous to the conventional refill operating mechanism, and capable of preventing a writing tip part of the refill from being projected out of the open front end of a barrel when a force on a touching level is applied to the push-button. The inventors found through the studies that the pressure necessary for operating the refill operating mechanisms of the conventional push-button writing instruments is in the range of 200 to 300 grams and the accidental projection of the writing tip part of the refill from the open front end of the barrel by an inadvertent touch to the push-button can be avoided by increasing the pressure necessary for operating the refill to project the writing tip part of the refill from the open front end of the barrel, and have made the present invention.

DISCLOSURE OF THE INVENTION

To achieve the foregoing object, the present invention provides a push-button writing instrument comprising a barrel having an open front end, a refill longitudinally slidably inserted in the barrel, containing a writing ink and having a writing tip part, a spring biasing the refill toward the back end of the barrel, a push-button fitted in a back end part of the barrel, and a refill operating mechanism capable of being operated by pushing the push-button to project the writing tip part of the refill from the open front end of the barrel and to retract the same into the barrel, in which the writing instrument has a push-button operating pressure for pushing the push-button against the biasing force of the spring in a range of 500 to 800 grams.

Typically, the writing ink is a thixotropic ink.

According to the present invention, the distance between the open front end of the barrel and the tip of the writing tip part when the writing tip part is retracted into the barrel is in a range of 2 to 5 mm, whereas the distance in the conventional pushbutton writing instrument is on the order of 1 mm. Therefore, the writing tip part of the refill of the push-button writing instrument of the present invention cannot inadvertently and easily be projected from the open front end of the barrel because of the above distance of 2 to 5 mm, even if a relatively high pressure is applied to the push-button with the hand. The distance greater than 5 mm is not desirable in view of operability.

According to the present invention, the term, push-button operating pressure, signifies a pressure to be applied with a finger to the push-button necessary for holding the writing tip part of the refill projected from the open front end of the barrel and is the sum of a pressure necessary for compressing the spring biasing the refill having the writing tip part toward the back end of the barrel, and frictional forces acting between the parts of the refill operating mechanism when the push-button is pushed. Since the push-button operating pressure is greatly dependent on the resilience of the spring, practically, the push-button operating pressure may be determined by selectively determining the resilience of the spring. The push-button operating pressure is measured by a push-pull scale. The push-button operating pressure is a maximum pressure required to hold the writing tip part projected from the barrel when the push-button is pressed by an attachment having a flat tip and attached to an end of a pressing rod of the push-pull scale.

There is the possibility that the writing tip part is projected when the push-button is touched with the hand or the like if the push-button operating pressure is lower than 500 grams. The push-button operating pressure exceeding 800 grams is excessively high, makes the operation of the push-button difficult and tends to scatter the ink by shocks that may be caused by the spring when the writing tip part is retracted into the barrel. Therefore, it is important that the push-button operating pressure is in the range of 500 to 800 grams.

Refill operating mechanisms employed in conventional push-button writing instruments include those of a rotating cam type, those of a projection-and-hole type and those of a heart grooved cam type. The present invention may employ a refill operating mechanism of any one of those types. and there is no particular restriction on the type of the refill operating mechanism.

BEST MODE FOR CARRYING OUT THE INVENTION

Figure 1:
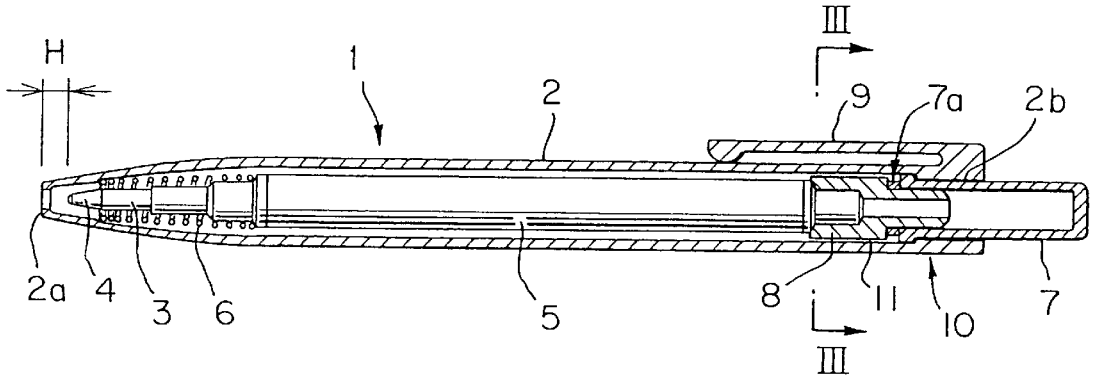
FIG. 1 is a longitudinal sectional view of a push-button writing instrument in a preferred embodiment of the present invention in a state where a writing tip part is retracted into a barrel.

Referring to FIG. 1, a push-button writing instrument 1 has a barrel 2, and a refill 5 slidably inserted in the barrel 2. The refill 5 contains a thixotropic ink, not shown. The thixotropic ink is filled directly in the refill 5. The refill 5 has a writing tip part 4 having a ball-point tip 3. The refill 5 is biased toward the back end of the barrel 2 by a coil spring 6. A known refill operating mechanism 10 is disposed behind the refill 5. A clip 9 is formed in a back end part of the barrel 2.

The refill operating mechanism 10 of a known construction comprises a push-button 7 inserted through an open rear end in the barrel 2 and partly projecting outside from the back end of the barrel 2, an annular cam portion 7*a* formed in a front end part of the push-button 7, a rotating cam 8 to be turned by the action of the cam 7*a*, and a grooved cam 11 formed in the inner surface of the barrel 2.

FIGS. 3 to 6 shows the relation between the rotating cam 8 and the grooved cam 11. The rotating cam 8 is provided on its outer surface with a plurality of longitudinal ridges 8*a*. Normally, the longitudinal ridges 8*a* are slidably inserted in longitudinal grooves 11*a* of the grooved cam 11. A sawtooth cam 11*b* is formed in the front end of the grooved cam 11. The annular cam 7*a* of the push-button 7 is formed by arranging a plurality of triangular projections in a circle.

Figure 2:
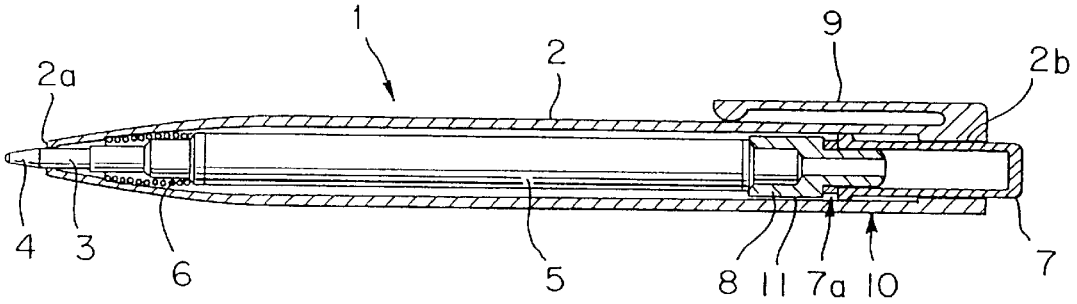
FIG. 2 is a longitudinal sectional view of the push-button writing instrument shown in FIG. 1 in a state where the writing tip part is projected from the front end of the barrel.
Figure 3:
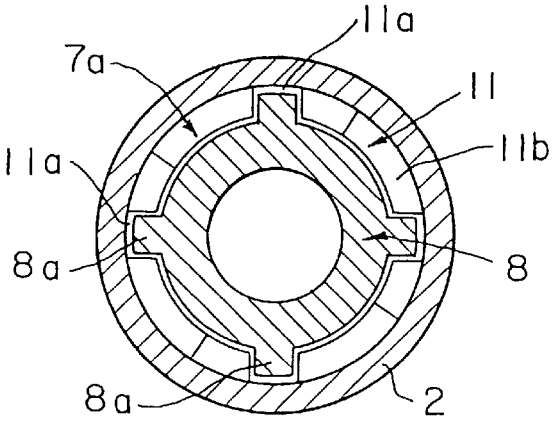
FIG. 3 is a sectional view taken on line III—III in FIG. 1.
Figure 4:
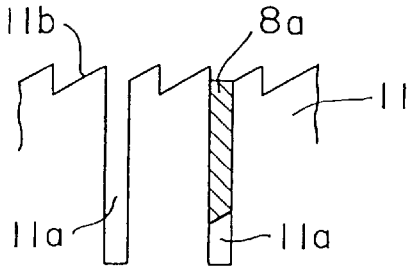
FIGS. 4 to 6 are diagrammatic views of assistance in explaining sequential operations of a cam when a push-button is operated.
Figure 5:
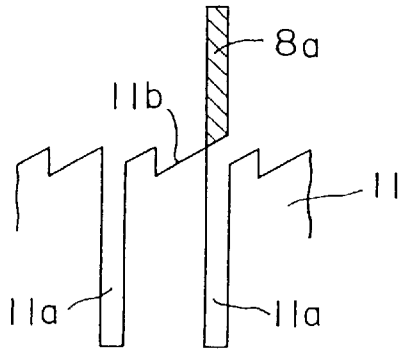
Figure 6:
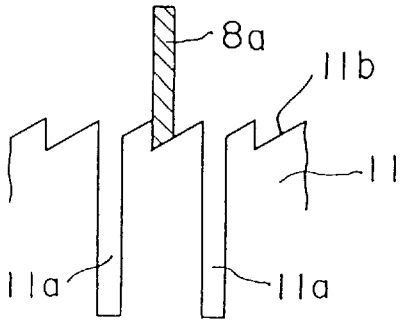

As is generally known, the rotating cam 8 advances when the push-button 7 is pushed forward with the thumb in a state wherein the writing tip part 4 is retracted behind the open front end 2*a* of the barrel 2 as shown in FIG. 1, and the ridges 8*a* fitted in the grooves 11*a* of the grooved cam 11 as shown in FIG. 4 are moved forward out of the grooves 11*a* as shown in FIG. 5. Because the annular cam portion 7*a* exerts a force on the rotating cam 8 in a circumferential direction, the ridges 8*a* are displaced in the same circumferential direction. When the pressure is removed from the push-button 7, the ridges 8*a* come into engagement with the sawtooth cam 11*b* formed in the front end of the grooved cam 11 as shown in FIG. 6. Consequently, the writing tip part 4 is projected from the open front end 2*a* of the barrel 2 as shown in FIG. 2 by the pushing action of the rotating cam 8 and is held at the projected position. The ridges 8*a* are moved forward away from the sawtooth cam 11*b* and is displaced in the circumferential direction when the push-button 7 is pushed again with the writing tip part 4 projected forward, the ridges 8*a* engage with the next grooves 11*a*, respectively, when the pressure is then removed from the push-button 7, and the ridges 8*a* are caused to slide backward along the grooves 11*a* to a position shown in FIG. 1 by the resilience of the coil spring 6.

The refill 5 is inserted in the barrel 2 so that the distance H between the open front end 2*a* of the barrel and the tip of the writing tip part 4 is in the range of 2 to 5 mm, preferably, about 3 millimeters (mm), when the writing tip part 4 of the refill 5 is retracted into the barrel 2. The coil spring 6 is designed and inserted so that the push-button operating pressure for operating the push-button 7 as measured by a push-pull scale is in the range of 500 to 800 grams, preferably, about 600 grams. The term, "push-button operating pressure" for operating the push-button 7 signifies a pressure needed to advance the ridges 8*a* of the rotating cam 8 from the position shown in FIG. 4 to a position where the ridges 8*a* are advanced beyond the grooves 11*a* of the grooved cam 11 when the refill operating mechanism 10 as shown is employed. Such requirements may be met, for example, when the coil spring 6 has a spring constant of 0.036 kg/mm and a compression by which the coil spring 6 is compressed from its free length to a length in the writing state is about 13 mm. The rest of the push-button operating pressure is frictional force acting between the parts of the push-button operating mechanism.

In the push-button writing instrument 1 in accordance with the present invention, the refill operating mechanism 10 including the rotating cam 8 operates to advance the refill 5 against the resilience of the coil spring 6 when an optional set pressure in the range of 500 to 800 grams, such as 600 grams, is applied to the push-button 7. Consequently, the writing tip part 4 is projected from the open front end 2*a* of the barrel as shown in FIG. 2 and is held in the projected state for writing.

Since the push-button writing instrument in accordance with the present invention is configured as above, the coil spring will not be compressed even if a hand or the like touches the push-button inadvertently when the push-button writing instrument is inserted in a pocket or the like because a pressure that may be exerted on the push-button by the simple touch of a hand on the push-button is less than 500 grams in most cases. Consequently, the writing tip part will not be projected inadvertently from the open front end of the barrel and the fabric forming the pocket or the like will not be stained. A push-button operating pressure exceeding 800 grams is excessively high and makes the operation of the push-button difficult. Such a difficulty does not occur in the push-button writing instrument of the present invention.

The push-button writing instrument in accordance with the present invention is able to employ a conventional push-button operating mechanism and does not need any additional safety mechanism which makes the construction of the push-button writing instrument complicated and needs additional parts. Thus the present invention is applicable to low-price push-button writing instruments.

What is claimed is:

1. A push-button writing instrument comprising:

a barrel having an open front end;

a refill longitudinally slidably inserted in the barrel, containing a writing ink and having a writing tip part;

a spring biasing the refill toward a back end of the barrel;

a push-button fitted in a back end part of the barrel; and a refill operating mechanism capable of being operated by pushing the push-button to project the writing tip part of the refill from the open front end of the barrel and to retract the same into the barrel;

wherein the writing instrument has a push-button operating pressure for pushing the push-button against the biasing force of the spring in a range of 500 to 800 grams.

2. The push-button writing instrument according to claim 1, wherein the push-button operating pressure is in a range of 600 to 800 grams.

3. The push-button writing instrument according to claim 1, wherein the writing ink is a thixotropic ink.

4. The push-button writing instrument according to claim 1, wherein the distance between the open front end of the barrel and a tip of the writing tip part when the writing tip part is retracted into the barrel is in a range of 2 to 5 mm.

5. The push-button writing instrument according to claim 4, wherein the distance between the open front end of the barrel and the tip of the writing tip part when the writing tip part is retracted into the barrel is about 3 mm.

* * * * *